US006033258A

United States Patent [19]

Huang et al.

[11] Patent Number: 6,033,258

[45] Date of Patent: Mar. 7, 2000

[54] STACKED CONNECTOR ASSEMBLY

[75] Inventors: Wayne Huang, Alhambra, Calif.; Kuo-Cheng Wang, Tu-Cheng, Taiwan

[73] Assignee: Hon Hai Precision Ind. Co., Ltd., Taipei Hsien, Taiwan

[21] Appl. No.: 09/053,406

[22] Filed: Apr. 1, 1998

[51] Int. Cl.[7] ..... H01R 13/73

[52] U.S. Cl. ..... 439/541.5; 439/79

[58] Field of Search ..... 439/541.5, 79, 439/607, 608, 540

[56] References Cited

U.S. PATENT DOCUMENTS

| | | | |
|---|---|---|---|
| 5,167,531 | 12/1992 | Broschard, III et al. | 439/540 |
| 5,346,404 | 9/1994 | Shimada | 439/108 |
| 5,603,639 | 2/1997 | Lai et al. | 439/607 |
| 5,643,010 | 7/1997 | Wu | 439/598 |
| 5,692,912 | 12/1997 | Nelson et al. | 439/79 |
| 5,816,831 | 10/1998 | Clark | 439/79 |
| 5,823,822 | 10/1998 | Tan et al. | 439/541.5 |

*Primary Examiner*—Gary F. Paumen
*Assistant Examiner*—Alexander Gilman

[57] ABSTRACT

A stacked connector assembly includes upper and lower electrical connectors mounted to each other. The upper and the lower connectors both include a first insulative housing having a front face for mating with a mating connector and a plurality of conductive contacts received in a plurality of passageways defined in the first housing. The upper connector further includes a pair of supports extending from a rear face of the first housing and a space defined under a bottom surface of the first housing in front of the supports for snugly receiving the lower connector. A spacer for an electrical connector having guiding keys is also proposed.

17 Claims, 12 Drawing Sheets

STACKED CONNECTOR ASSEMBLY

BACKGROUND OF THE INVENTION

1. Field of the Invention

The present invention relates to an electrical connector assembly, particularly to a stacked connector assembly.

2. The Prior Art

To economically use the limited space within the computer case, stacked connector assemblies are popularly used in the computer field. Some stacked connector assemblies were proposed in, for example, U.S. patent application Ser. Nos. 08/651,565 and 08/746,246 assigned to the same assignee of the present invention. These stacked connector assemblies, though comprising more than one connectors stacked together, require a bracket interposed therebetween for combining the connectors as a whole, which increases the number of main components in the assemblies and thus involves a complicated process to assemble these components. In addition, in the above-mentioned conventional design, the spacer is integrally formed with the housing, which is not convenient in use. Hence, there is a need for a stacked connector assembly which involves less main components and can be assembled more easily than it was and which comprises a spacer formed separately from the housing and capable of being assembled to the housing easily.

SUMMARY OF THE INVENTION

Accordingly, one object of the present invention is to provide a stacked connector assembly without requiring a bracket interposed therein for combining the connectors as a whole.

Another object of the present invention is to provide a stacked connector assembly having a reduced number of main components and to simplify the assembling process.

Still another object of the present invention is to provide a stacked connector assembly which has a simplified assembling process.

One more object of the present invention is to provide a stacked connector assembly which has a spacer that can be formed separately from the housing and assembled to the housing easily.

To fulfill the above-mentioned objects, according to one embodiment of the present invention, a stacked connector assembly comprises upper and lower electrical connectors of the same type, and means having parts integrally formed with the upper and the lower connectors, respectively, for retaining the upper and lower connectors to each other. The upper and lower connectors both include a first insulative housing having a front face for mating with a first mating connector and a plurality of conductive contacts received in a plurality of passageways defined in the first housing. The upper connector further comprises a pair of supports extending from a rear face of the first housing and a space defined under a bottom surface of the first housing in front of the supports for snugly receiving the lower connector.

According to another aspect of the invention, a spacer for an electrical connector is also proposed, which comprises a front thin bar and a rear thick bar integrally formed together, each bar defining two rows of staggered tapered apertures extending between top and bottom surfaces thereof for guiding and positioning conductive contacts extending therethrough. A pair of hooks are formed on opposite lateral sides of the spacer for locking into an electrical connector and a pair of up-standing keys taller than the hooks are provided on both lateral ends of the front bar for guiding attachment of the spacer to an electrical connector.

These and additional objects, features, and advantages of the present invention will become apparent after reading the following detailed description of the embodiments of the invention taken in conjunction with the appended drawing figures.

DETAILED DESCRIPTION OF THE PREFERRED EMBODIMENTS

Detailed reference will now be made to the preferred embodiments of the present invention.

Figure 1:
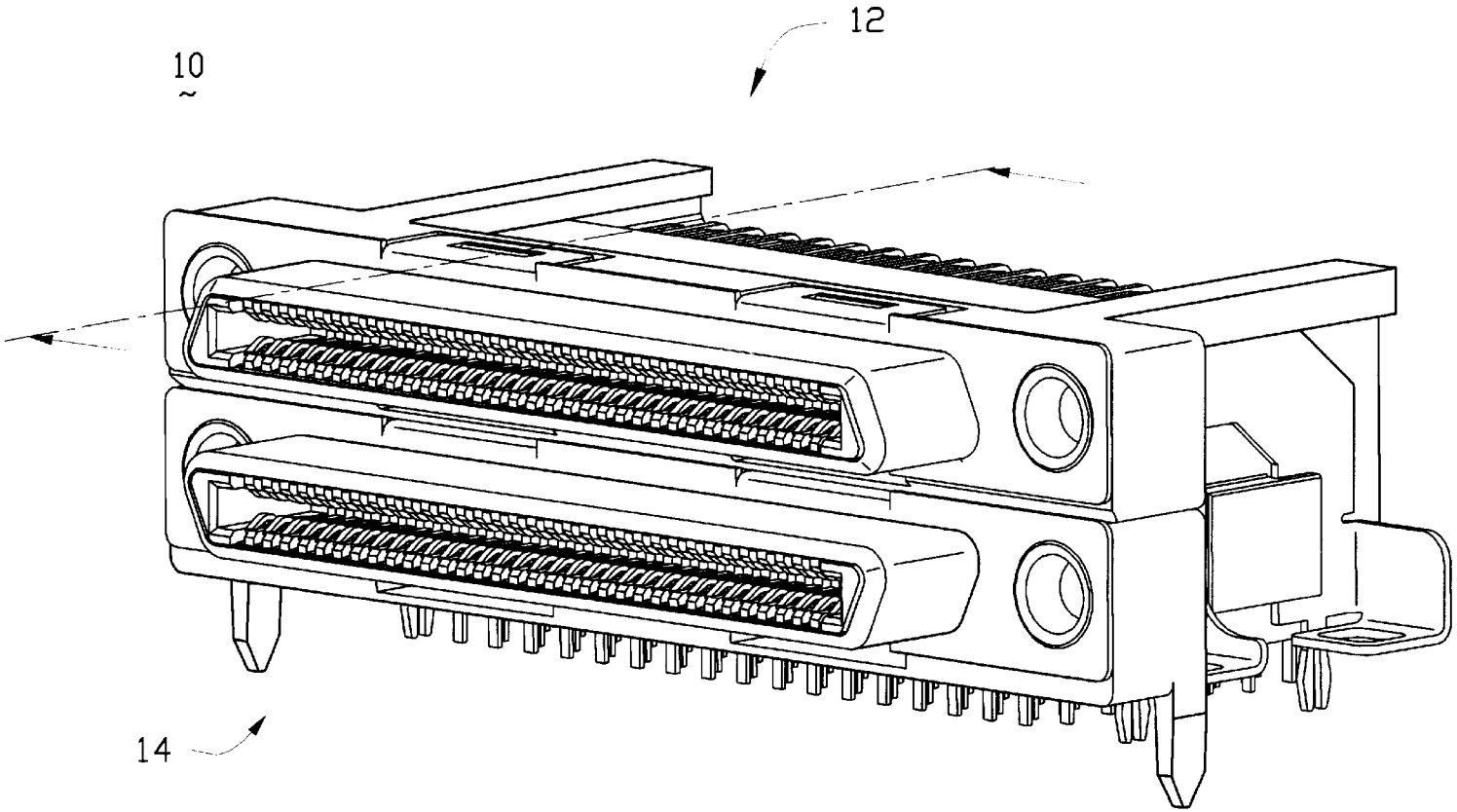
FIG. 1 is a perspective view of a stacked connector assembly according to a preferred embodiment of the present invention.
Figure 2:
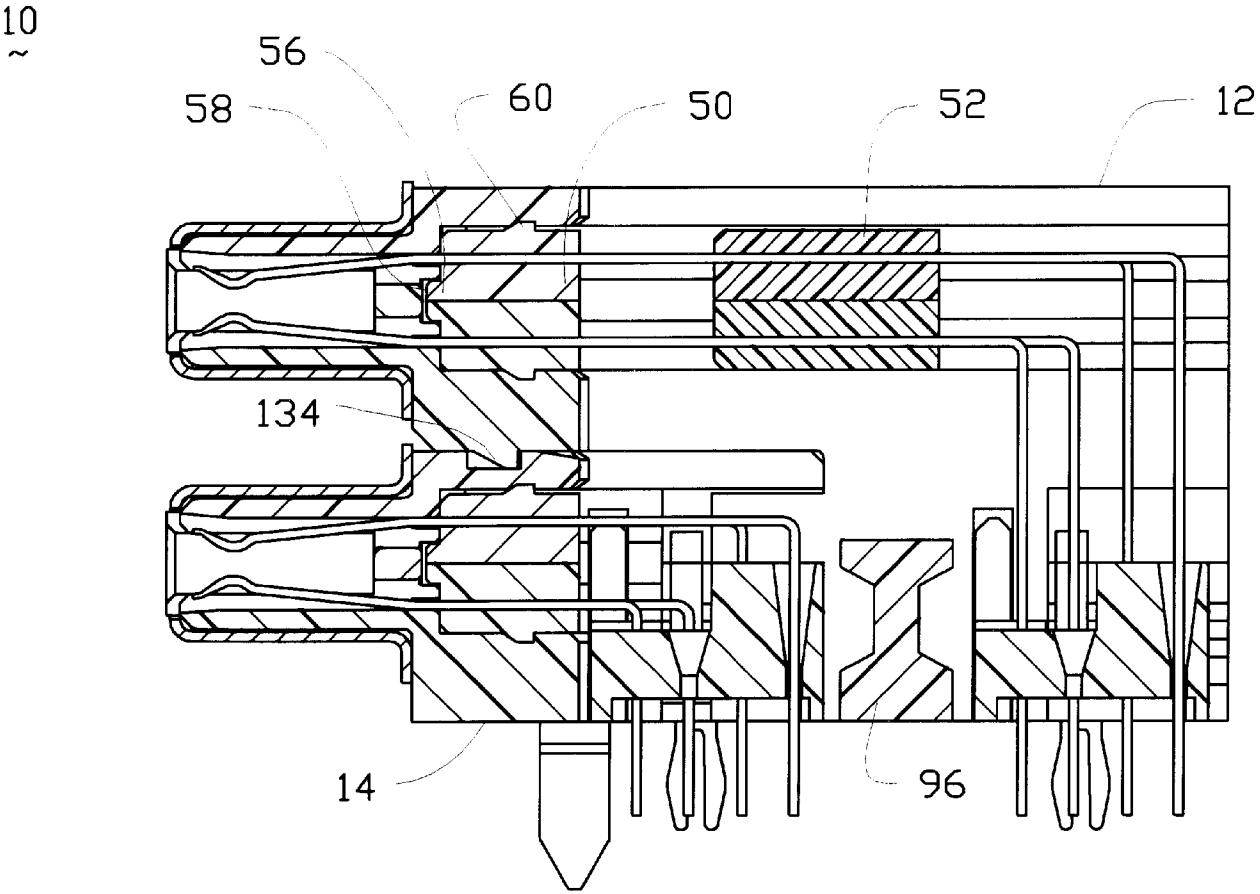
FIG. 2 is a cross-sectional view of the stacked connector assembly shown in FIG. 1.
Figure 3:
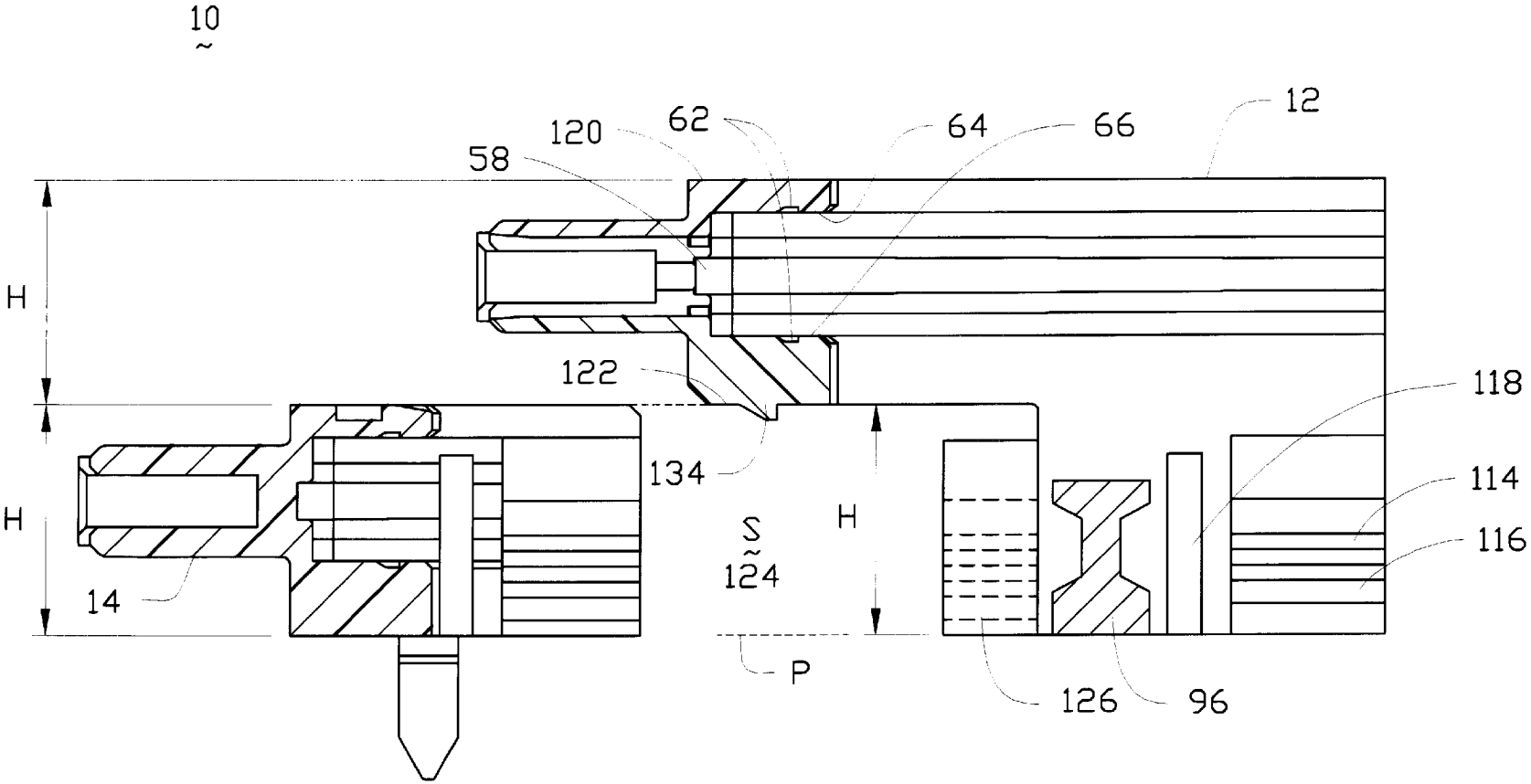
FIG. 3 shows a cross-sectional view of the upper connector and the lower connector of the stacked assembly of FIG. 1.

Referring first to FIGS. 1 to 3, a stacked connector assembly according to the present invention, generally designated by reference numeral 10, mainly comprises a first upper connector 12 and a second lower connector 14 secured to the upper connector 12.

Figure 4:
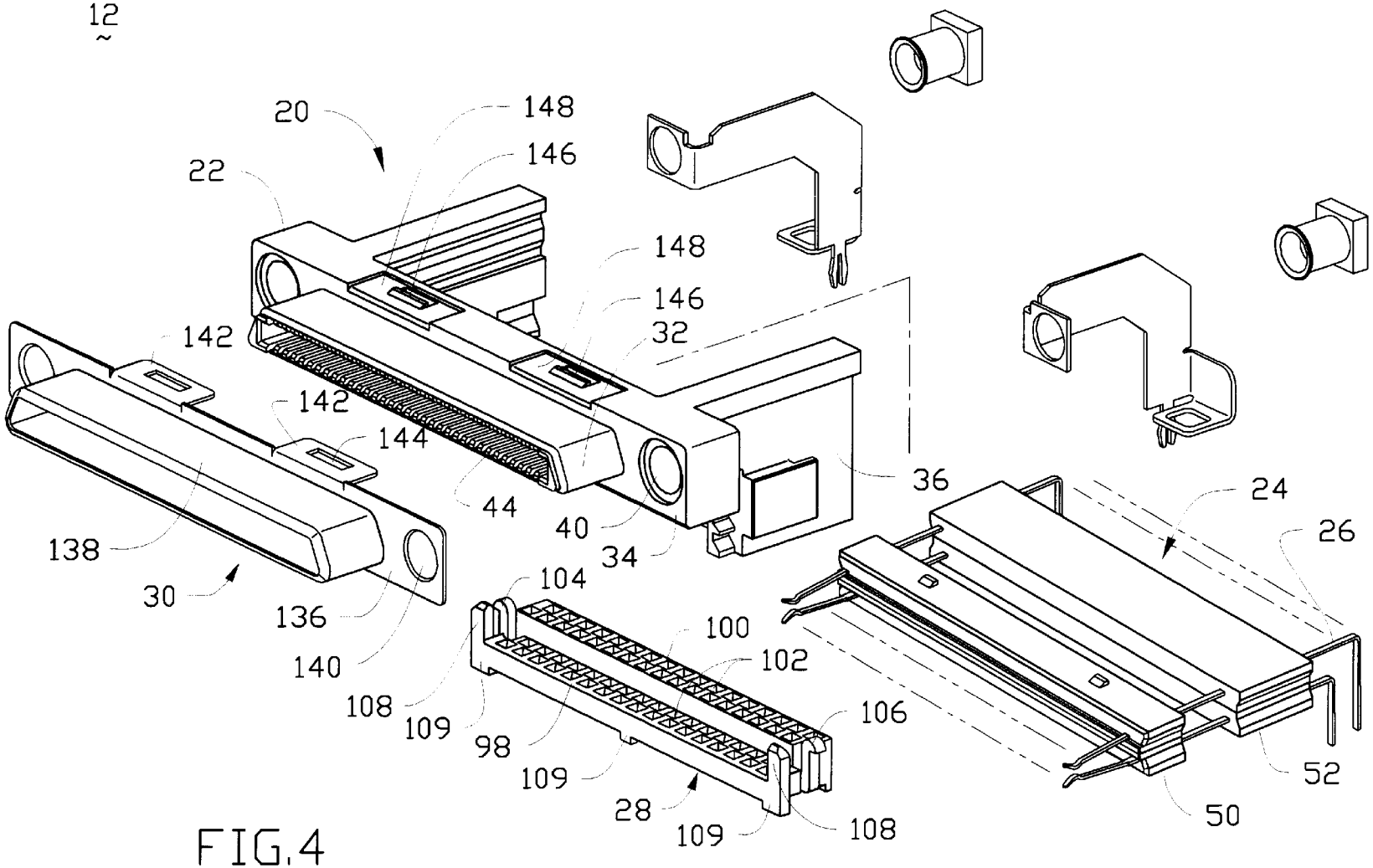
FIG. 4 is an exploded perspective view of the upper connector of the stacked assembly shown in FIG. 1.
Figure 5:
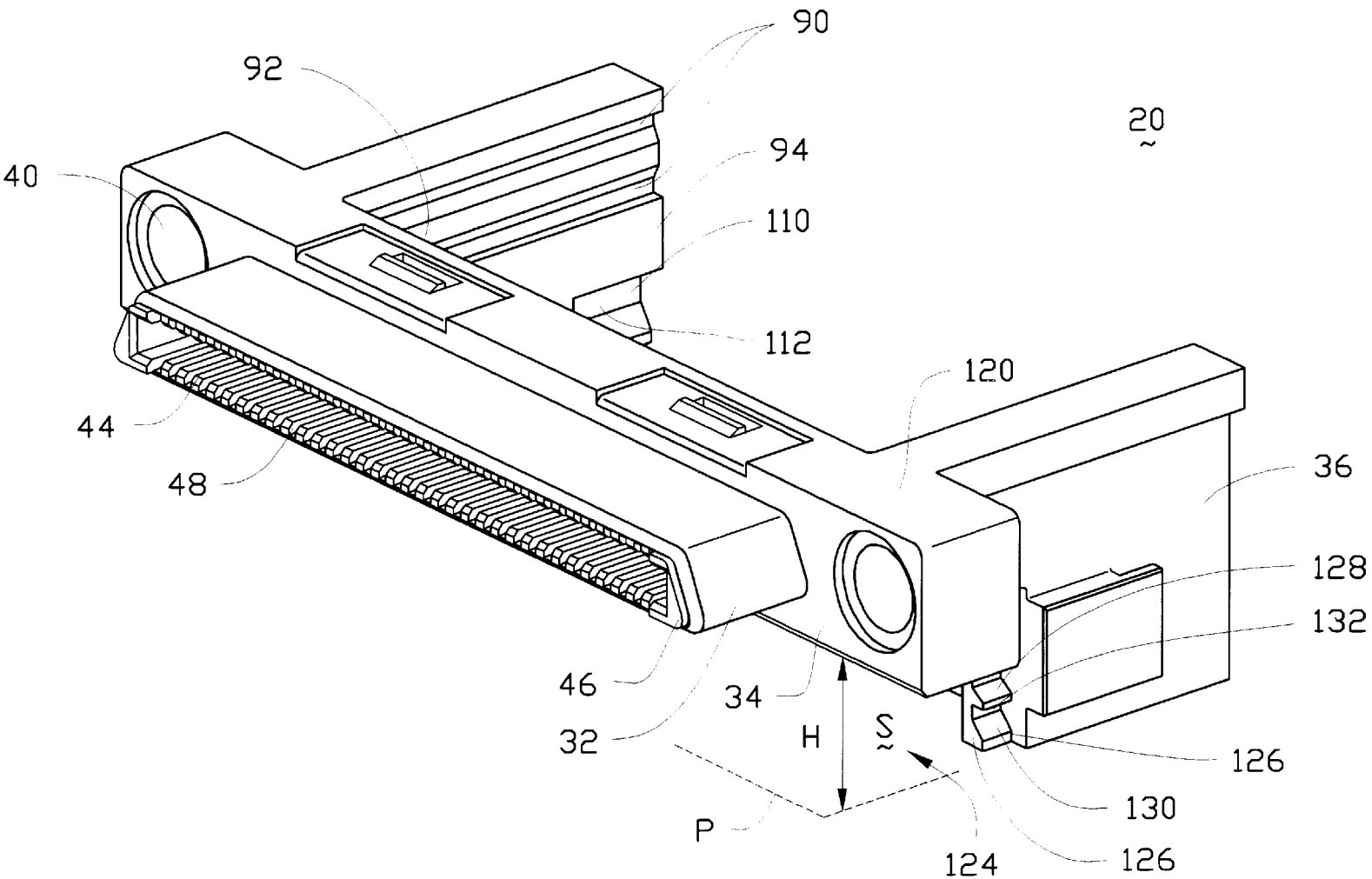
FIG. 5 is a front, upper perspective view of the upper connector.
Figure 6:
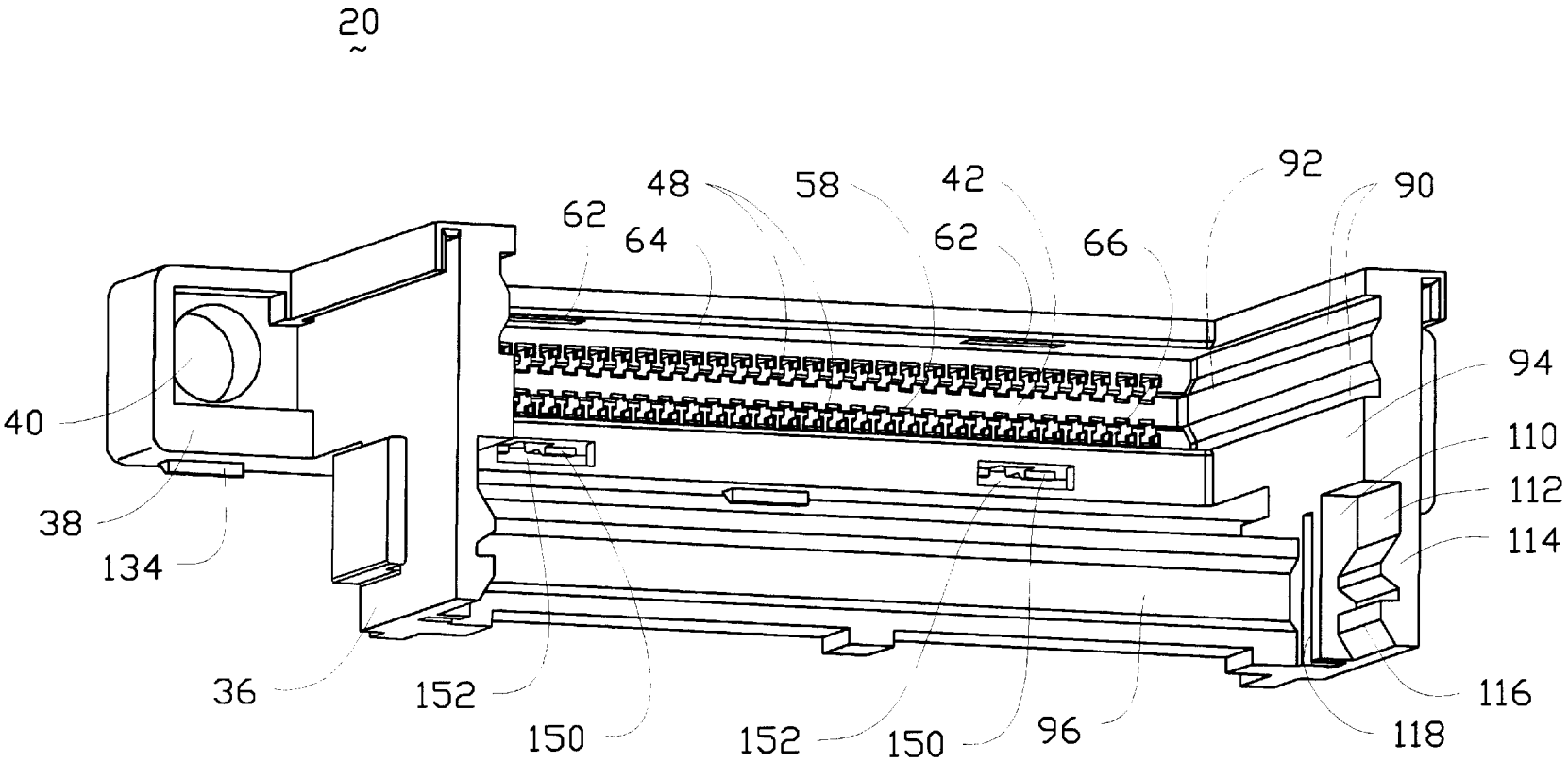
FIG. 6 is a rear, lower perspective view of the upper connector.

Please further refer to FIGS. 4 to 6. The upper connector 12 mainly comprises an insulative housing 20 having an elongated main body 22, a contact module 24 containing a plurality of conductive contacts 26, a spacer 28, and a metal shield 30.

The housing 20 includes a mating protrusion 32 projecting forward from a front face 34 of the main body 22 for mating with a mating connector (not shown), a pair of supports 36 extending rearward from a rear face 38 of the main body 22 for supporting the upper connector 12 in an elevated level and for the attachment of the spacer 28, and a pair of screw holes 40 defined near both lateral ends of the main body 22 through the front face 34 and the rear face 38.

An elongated central cavity 42 is defined in the main body 22 and open to an exterior for receiving the contact module 24 inserted from the rear face 38 of the main body 22. An elongated mating opening 44 is defined in a front face 46 of the mating protrusion 32 for receiving a mating portion of the mating connector (not shown). Two rows of passageways 48 are formed between the central cavity 42 and the mating opening 44 and extend in an upper and a lower inner surface of the mating opening 44 for positioning a front portion (not labeled) of the contacts 26 of the contact module 24.

Figure 10:
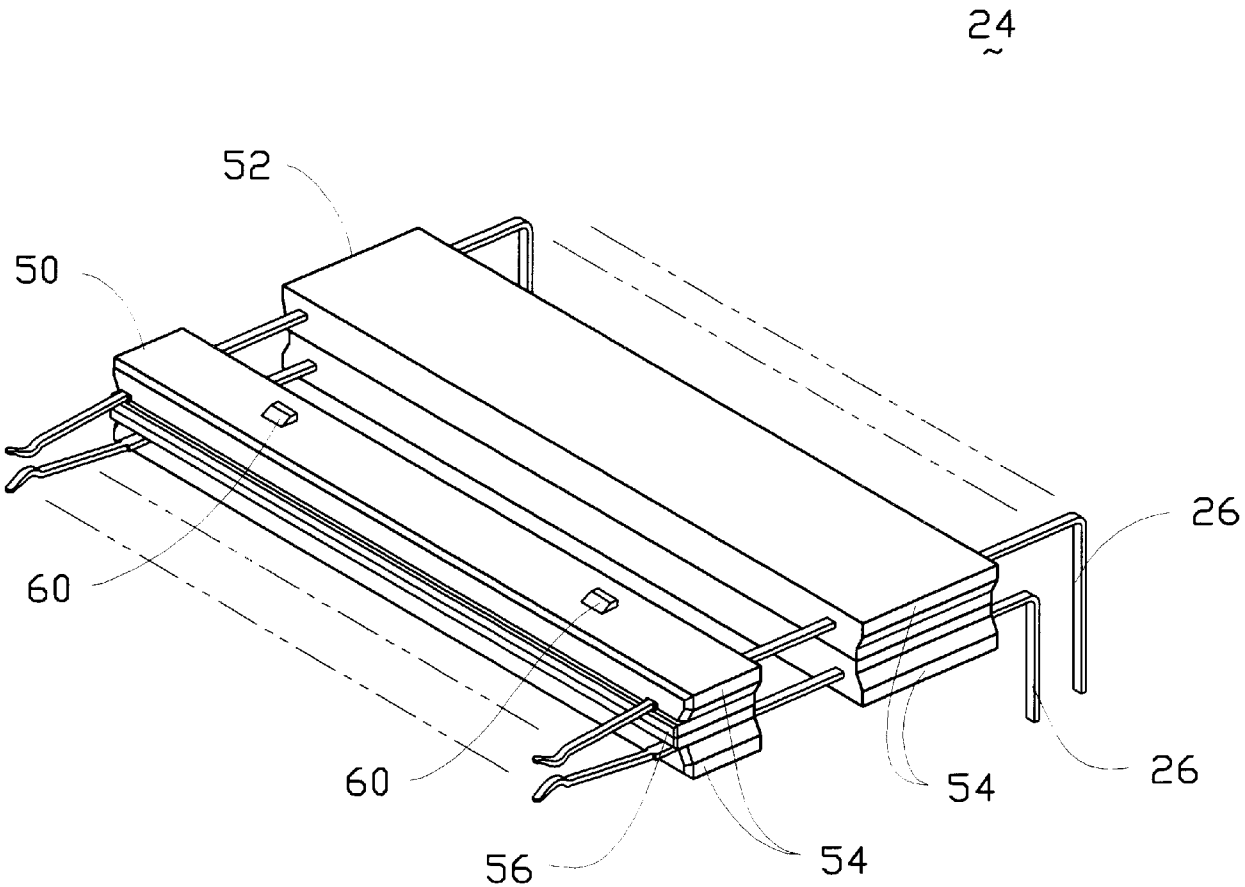
FIG. 10 is a front perspective view of the contact module of the upper connector.
Figure 11:
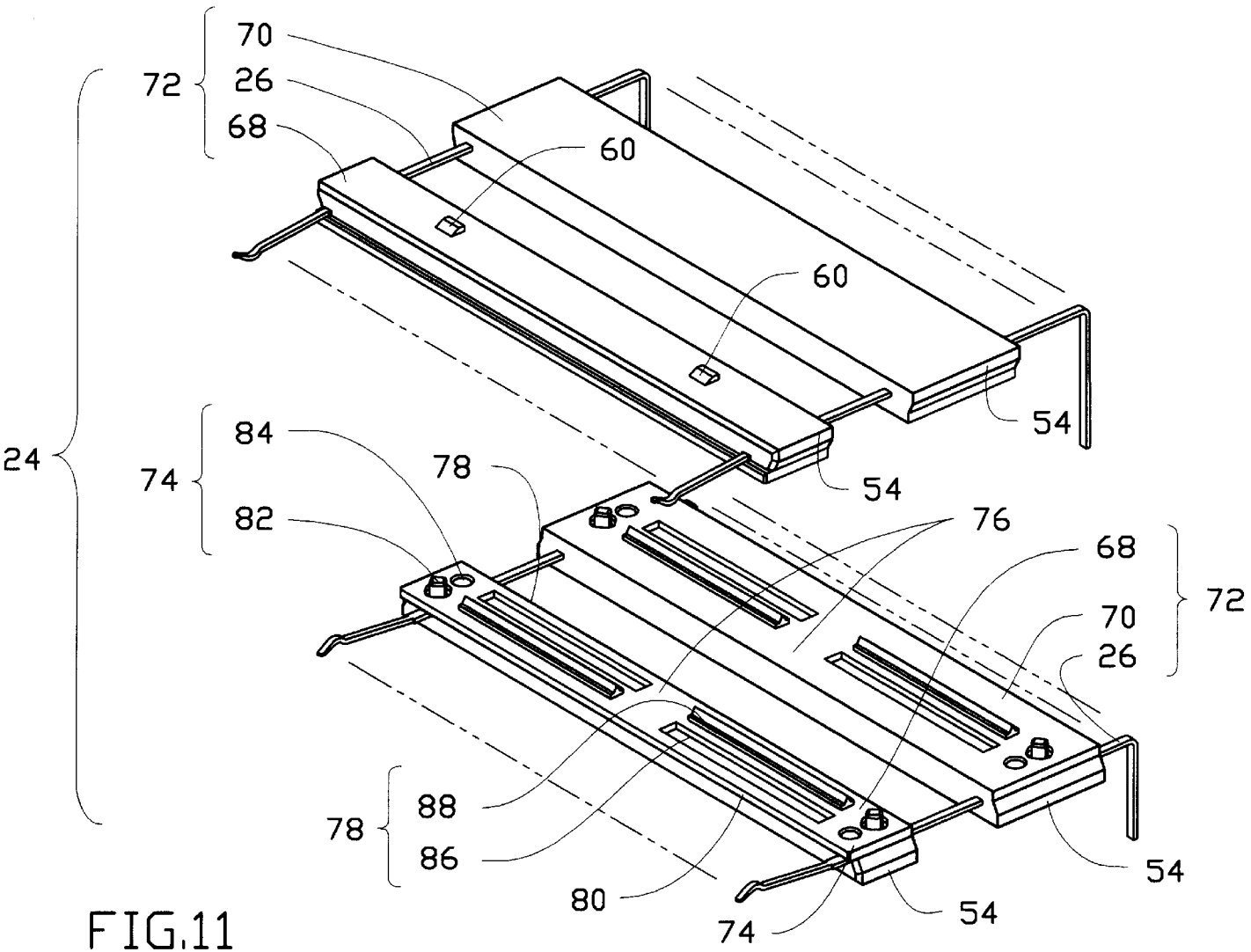
FIG. 11 is an exploded perspective view of the contact module of the upper connector.

Please refer to FIGS. 10 to 11. The contact module 24 includes two rows of contacts 26 integrally retained in a front block 50 and a rear block 52. Each of the front and rear blocks 50, 52 comprises a pair of upper and lower flanges 54, respectively, on each lateral side thereof for securing to the housing 20. The front block 50 further comprises a transverse protrusion 56 on a front side thereof for fitting into a transverse recess 58 defined on an innermost surface of the central cavity 42 of the housing 20, as shown in FIGS. 2, 3 and 6. Two pairs of ribs 60 are formed on upper and a lower surfaces of the front block 50 for retention in two pairs of detents 62 defined on an inner upper and an inner lower surface 64, 66 of the central cavity 42 of the housing 20, as shown in FIG. 3.

In manufacturing, each row of contacts 26 are transversely aligned horizontally up side by side and inserted molded in a front plate 68 and a rear plate 70 to form a contact set 72 with the right-angled tail portions of the contacts 26 staggered in two rows. Next, two contact sets 72 are jointed together by means of joint means 74 formed on a jointing face 76 defined on each of the plates 68, 70. Since the tail portions of the contacts 26 in the two contact sets 72 are bent at different locations and in opposite direction relative to the their respective jointing faces 76, there are four rows tail portions of the contacts 26 in the jointed contact sets 72. Finally, the jointed contact sets 72 are processed by ultrasonic welding procedure to bond the two pairs of plates 68, 70 into the front and rear blocks 50, 52, respectively, so that a unitary contact module 24 including the front and rear blocks 50, 52 with two rows of contacts 26 integrally retained therein is completed. Since the structures of the plates 68, 70 are similar, only the structure of the front plate 68 will be described in detail.

The front plate 68 comprises two sets of joint means 74 on an upper surface and near both lateral sides thereof, two sets of bonding means 78 between the joint means 74, a pair of flanges 54 formed on both lower lateral edges of the plate 68, a flange 80 formed on an upper front edge of the plate 68, and a pair of ribs 60 formed on a lower surface of the plate 68. Each set of the joint means 74 includes a square post 82 and a circular hole 84 and each set of bonding means 78 includes an elongated slot 86 and a strip 88 wherein the posts 82 and holes 84 in the two sets of joint means 74 are located in exchanged positions and so do the elongated slots 86 and strips 88 of the bonding means.

When the pair of plates 68 are jointed together, the two sets of joint means 74 of one front plate 68 interferingly engage with another two sets of joint means 74 of the other front plate 68 with the posts 82 of plates 68 fitting into the holes 84 of the mating plates 68, the elongated slots 86 and strips 88 in one plate 68 engage the strips 88 and slots 86 of the other plate 68, respectively, and the two front flanges 80 overlap and form the transverse protrusion 56 of the block 50. The strips 88 will melt during the ultrasonic welding procedure, and bond to the slots 86 when they are cold.

In this embodiment, the rear plate 70 does not include the front flange 80, and thus the rear block 52 formed by two rear plates 70 does not include the transverse protrusion 56. It is noted that in another embodiment the rear plate 70 can also include the front flange 80 and thus the rear block 52 also includes the transverse protrusion 56 to simplify the molding of the blocks 50, 52.

Please refer back to FIGS. 5 and 6. The support 36 is substantially a rectangular wall integrally formed with the main body 22 of the housing 20 beside the central cavity 42. Two guiding grooves 90 defined in each lateral surface 92 of the central cavity 42 extend in an inner surface 94 of the support 36 for guiding the horizontal movement of the flanges 54 of the front and rear blocks 50, 52 during insertion of the contact module 24 into the central cavity 42 and for preventing vertical movement of the blocks 50, 52, and in turn, of the contact module 24 with respect to the housing 20 after insertion. A transverse beam 96 (see FIGS. 2 and 3) is provided between the supports 36 for reinforcing the strength of the housing 20 and for keeping a constant distance between the supports 36 so as to snugly receive the spacer 28 therebetween.

Figure 7:
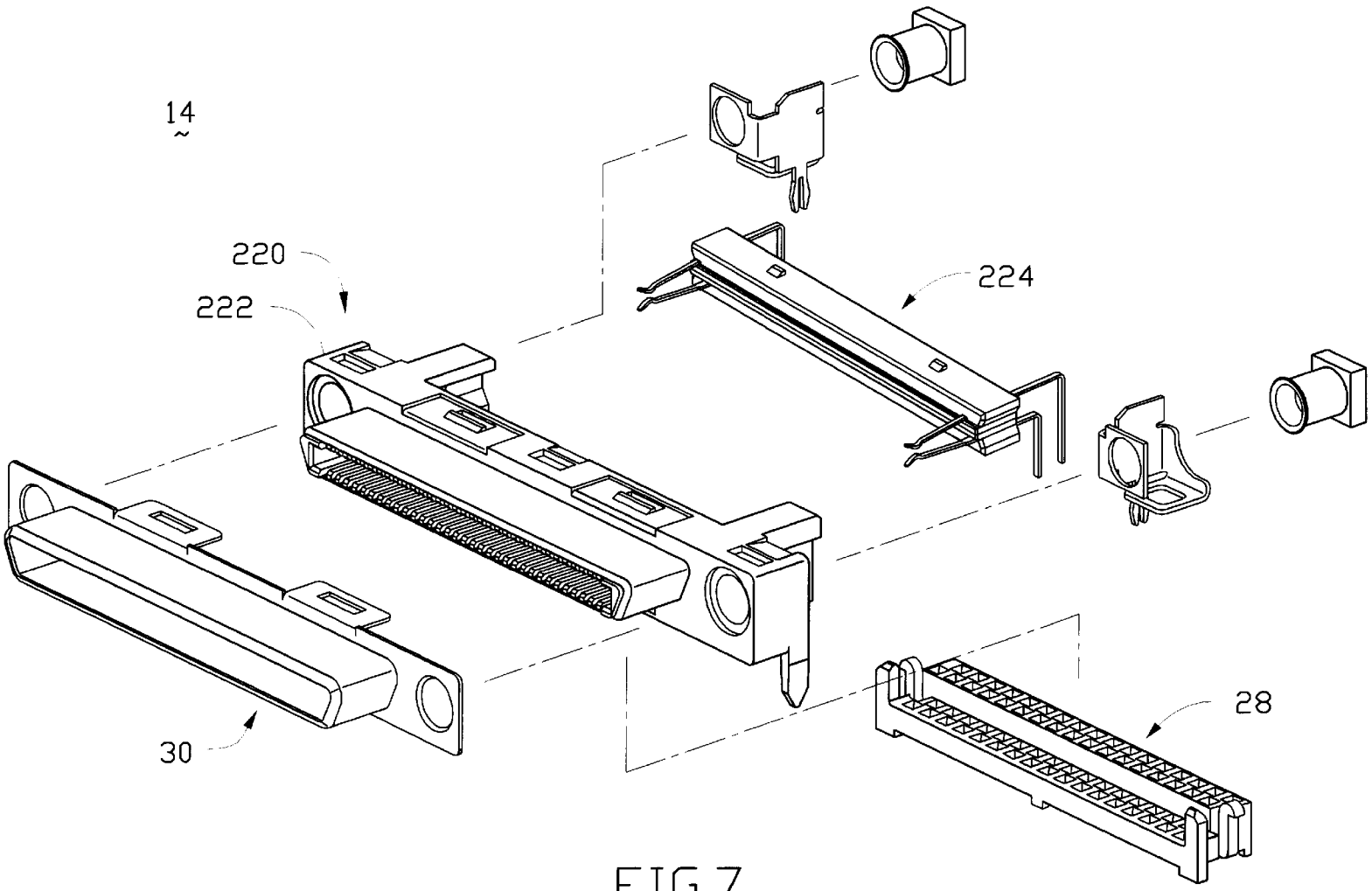
FIG. 7 is an exploded perspective view of the lower connector of the stacked assembly shown in FIG. 1.

Please refer to FIGS. 2, 4 and 7. The spacer 28 comprises a front thin bar 98 and a rear thick bar 100 integrally formed together. Each of the bars 98, 100 defines two rows of staggered tapered apertures 102 extending between top and bottom surfaces thereof for guiding and positioning the contacts 26. A pair of hooks 104, 106 are formed on opposite lateral sides of the spacer 28, one for each bar 98, 100, for locking the spacer 28 between the supports 36 and a pair of up-standing keys 108, which are taller than the pair of hooks 104, 106, are provided on both lateral ends of the front bar 98 for guiding attachment of the spacer 28 to the supports 36. In addition, six standoffs 109 are provided on a bottom surface of the spacer 28 located near edges thereof.

Please refer to FIGS. 3, 5 and 6. A recess 110 is defined in the inner surface 94 of the support 36, near a lower, rear portion of the support 36 and has a lateral inner surface 112. Upper and lower horizontal retention ridges 114, 116 are formed on the lateral inner surface 112 for retaining the hooks 104, 106 of the spacer 28. A vertical slit 118 is defined in the inner surface 94 of the support 36 ahead of the recess 110 for receiving the keys 108 of the spacer 28.

Please further refer to FIG. 3. A top surface of the support 36 is flush with a top surface 120 of the main body 22 and the height of the support 36 is substantially twice as much as that of the main body 22 such that a bottom surface of the support 36 is substantially lower than a bottom surface 122 of the main body 22 by the height "H" of the main body 22. Therefore, a space 124, "S", is defined between the bottom surface 122 of the main body 22 and a plane "P" coplanar with the bottom surface of the support 36 for receiving the lower connector 14.

The upper connector 12 further comprises a pair of positioning plates 126 extending forward from both of the supports 36, each defining upper and lower horizontal retention grooves 128, 130 on a lateral outer surface 132 thereof for positioning the lower connector 14. In addition, three ribs 134 are formed on the lower surface of the main body 22 for locking into the lower connector 14.

Please refer to FIGS. 4 and 7. The metal shield 30 comprises a main plate 136, a hollow shell 138 drawn forward from a central portion thereof, a pair of screw holes 140 defined in both ends of the main plate 136, and two pairs of mounting ears 142 respectively extending rearward from a top edge and a bottom edge of thereof. When the metal shield 30 is mounted to the housing 20, the main plate 136 abuts against the front face 34 of the main body 22 of the housing 20 with the hollow shell 138 conformably encompassing the mating protrusion 32 and the screw holes 140 aligning with the screw holes 40 of the housing 20 (see FIG. 1). Each of the mounting ears 142 of the metal shield 30 defines a central slot 144. Each of the central slots 144 defined in the upper mounting ears 142 retains a rib 146 formed on a recession 148 defined in top surface 120 of the main body 22 of the housing 20 and each of the central slots 144 defined in the lower mounting ears 142 retains at least one rib 150 formed on an inner top surface of a recession 152 defined in the front face 34 of the main body 22 below the mating protrusion 32 (see FIG. 6).

Figure 8:
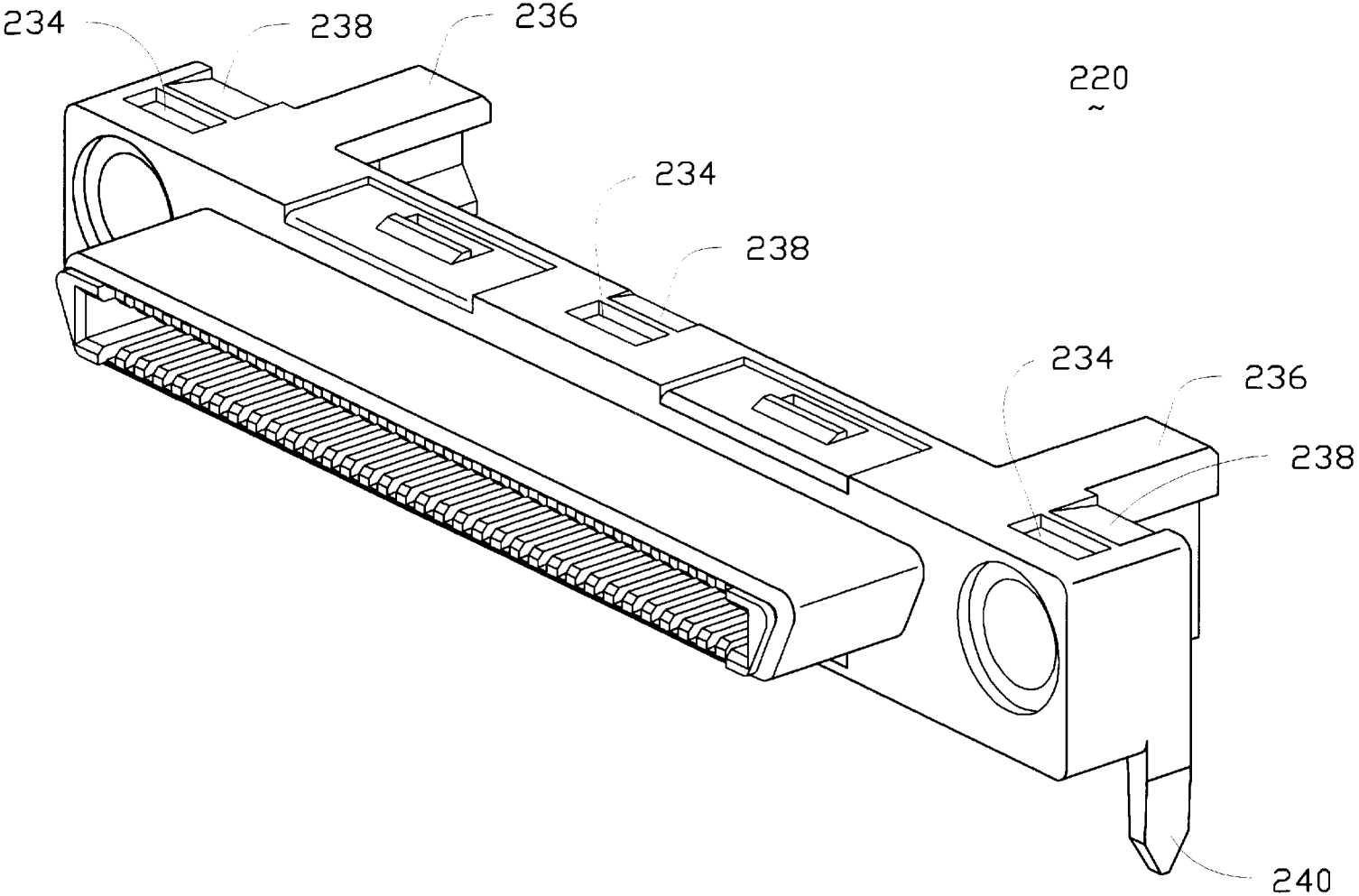
FIG. 8 is a front, upper perspective view of the lower connector.
Figure 9:
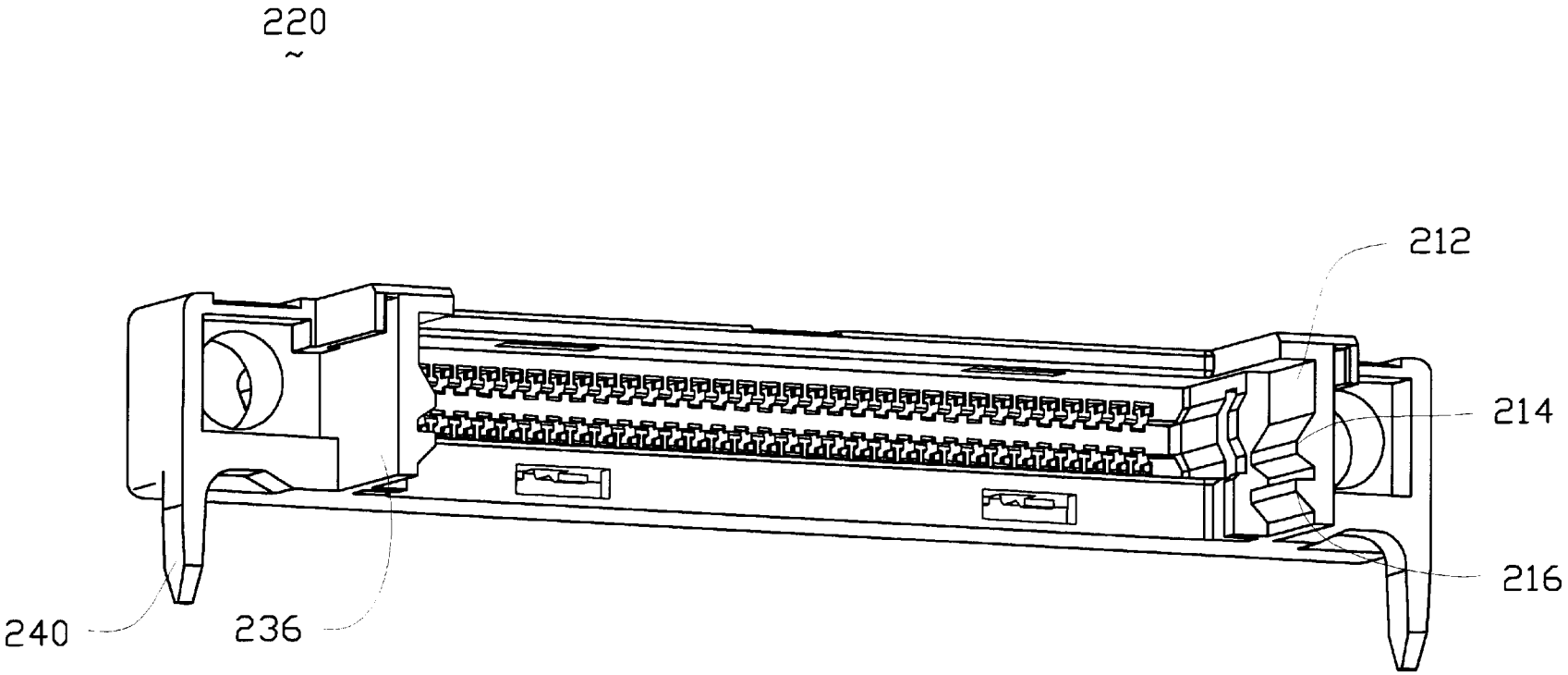
FIG. 9 is a rear, lower perspective view of the lower connector.

Please refer to FIGS. 7 to 9. The structure of the lower connector 14 is similar to that of the upper connector 12, and mainly comprises an insulative housing 220, a contact module 224, a spacer 28, and a metal shield 30.

The housing 220 is substantially similar to the housing 20 except for the following differences. The housing 220 comprises two positioning walls 236 extending rearward in place of the supports 36 of the housing 20. The positioning walls 236 extend rearward from a rear surface of a main body 222 of the housing 220, and each defines upper and lower horizontal retention ridges 214, 216 formed on a lateral inner surface 212 thereof, as are the ridges 114, 116 of the supports 36 of the upper connector 12, for retaining the hooks 104, 106 of the spacer 28 and for complementarily positioning into the upper and lower horizontal retention grooves 128, 130 of the positioning plates 126 of the support 36 of the upper connector 12, as can be seen in FIGS. 3 and 5.

In addition, three detents 234 are formed on an upper surface of the main body 222 for retention of the three ribs 134 of the lower surface of the main body 22 of the upper connector 12, and a recessed slant surface 238 is provided on a rear portion of each detent 234 for guiding the entrance of the rib 134 into the detent 234.

Please refer to FIG. 3. Since the height of the main body 222 of the lower connector 14 is substantially the same as that of the upper connector 12 "H" and upper and lower surfaces of the positioning walls 236 are flush with those of main body 222, the lower connector 14 can then be snugly received within the space 124 ("S") of the upper connector 12.

The lower connector 14 further comprises a pair of posts 240 extending downward from both lateral ends of the main body 222 for locking into a PC board (not shown) on which the lower connector 14 is to be mounted.

Figure 12:
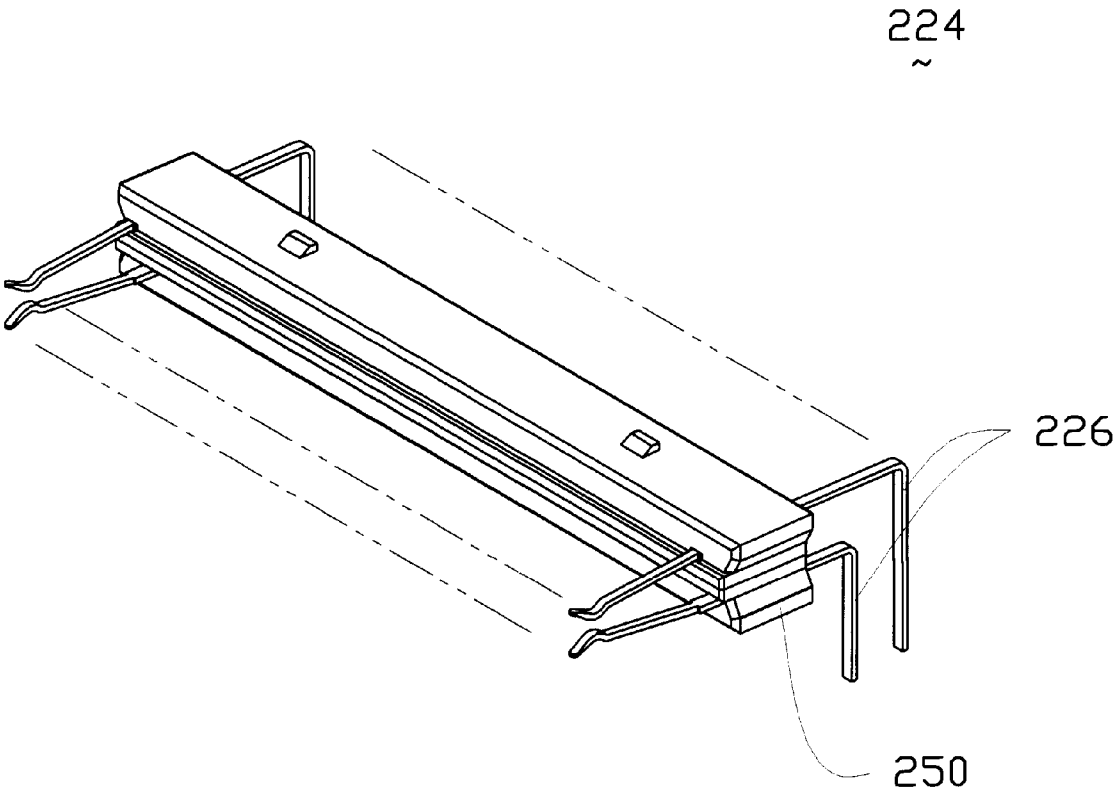
FIG. 12 is a front perspective view of the contact module of the lower connector.

Please further refer to FIG. 12. The contact module 224 is similar to the contact module 24 of the upper connector 12, including two rows of contacts 226 integrally retained in a block 250. The structure and manufacture of the block 250 are substantially the same as the front block 50 of the upper connector 12, and thus will not be further described hereinafter.

As can be seen in FIGS. 2 and 3, in assembling, the lower connector 14 is inserted into the space "S" 124 of the upper connector 12 from a lower front position thereof. With the cooperation of the positioning walls 236 and detents 234 of the lower connector 14 with the positioning plates 126 and ribs 134 of the upper connector 12, respectively, the two connectors 12, 14 can be effectively stacked together.

Although in the preferred embodiment the lower connector 14 is designed to be stacked with the upper connector 12, it can also be use singly as a non-stacked connector.

In the present embodiment, the larger supports 36 are provided on the upper connector 12 and the smaller positioning walls 236 are provided on the lower connector 14; however, the larger supports 36 can be provided on the lower connector 14 rather than on the upper connector 12 and the smaller positioning walls 236 can be provided on the upper connector 12 rather than the lower connector 14 to retainably engage with each other.

Although in the preferred embodiment, the upper and lower connectors 12, 14 are of the same type, it should be noted that, alternatively, the lower connector 14 can be of different type from the upper connector 12 and has a structure different from that of the upper connector 12 while defining a dimension capable of being snugly received in the space 124 of the upper connector 12 and including means retainably engaging with the upper connector 12.

In a variation of the present invention, more than one lower connector can be snugly received in the space 124 of the upper connector 12 and each of the lower connectors 14', 14" includes means retainably engaging with the upper connector 12.

It is also noted that the mating protrusion 32 of the upper connector 12 is of an upside-down D-shaped configuration and the mating protrusion (not numbered) of the lower connector 14 is of an upstanding D-shaped configuration. This mirror image arrangement of these two D-shaped mating protrusions of the upper and the lower connectors 12, 14, allows thicker/stronger structures on one side, i.e., the shorter edge of the D-shaped configuration of each corresponding mating cable connector (not shown), thus resulting in more flexible and optional in designing the complementary mating cable connector. This arrangement is important in this invention because the upper connector 12 and the lower connector 14 are directly, closely and tightly stacked on each other with a tiny vertical distance between the mating protrusions of the upper connector 12 and the lower connector 14.

It is also seen that one feature of the invention is that different from the rib 146 formed in a recession 148 which is exposed to an exterior on the top surface 120 of the main body 22 of the housing 20, the rib 150 is formed in the recession 152 which is hidden by a plate constituting a bottom surface 122 thereof wherein the bottom surface 122 is designedly provided to intentionally engage a top surface of a main body of the lower connector 14. In most conventional connectors, the upper recession 148 and the lower recession 150 are both exposed to the exterior because they are of the single type requiring no bottom surface thereof to engage the top surface of another connector thereunder.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. A stacked connector assembly, comprising:

an upper electrical connector comprising a first insulative housing having a front face adapted to mate with a first mating connector, a plurality of conductive contacts retained in passageways defined in the first housing, a pair of support walls extending from a rear face of the first housing and a pair of positioning plates extending forward from the support walls defining a space therebetween under the first housing, the first housing forming at least one rib; and a lower electrical connector received in said space of the upper connector comprising a second insulative housing having a front face adapted to mate with a second mating connector, a plurality of conductive contacts retained in passageways defined in the second housing, a pair of positioning walls extending rearward from the second housing for retainably engaging with said positioning plates of the first connector, the second housing defining at least one detent for engaging with the rib of the first housing, a slant surface being formed on the second housing for guiding the rib into the detent.

2. The stacked connector assembly as claimed in claim 1, wherein said pair of positioning walls of the second housing have a pair of surfaces complementarily positioning a pair of surfaces of said positioning plates of the first housing.

3. The stacked connector assembly as claimed in claim 1 further comprising a transverse beam provided between the support walls of the first housing.

4. An electrical connector housing for use in a stacked connector assembly comprising:

an insulative main body having a front face adapted to engage with a mating connector;

a central cavity defined in the main body and exposed to an opposite rear face thereof, the central cavity having an innermost surface in which a transverse recess is defined, the transverse recess being adapted to receive and retain a protrusion formed on a contact module which retains a plurality of conductive contacts;

a plurality of conductive contact receiving passageways defined in the main body in communication with said central cavity for receiving the conductive contacts of the contact module therein;

a pair of supports extending from a rear face of the main body; and a space defined under the main body adapted to receive a second connector of said stacked connector assembly.

5. The electrical connector housing as claimed in claim 4, wherein the supports have inner surfaces, said housing further comprising retention means formed on the inner surfaces of the supports adapted to engage with and retain a spacer.

6. The electrical connector housing as claimed in claim 5, wherein said retention means comprises upper and lower grooves defined in each of said inner surfaces for engaging with hooks formed on the spacer.

7. The electrical connector housing as claimed in claim 6, wherein said retention means further comprises a vertical slit defined in each of the supports for guidingly receiving a corresponding guiding key formed on the spacer.

8. The electrical connector housing as claimed in claim 4 further comprising means formed on inner lateral surfaces of said central cavity for retaining the contact module.

9. The electrical connector housing as claimed in claim 8, wherein said means for retaining the contact module comprises at least one guiding groove defined in each inner lateral surface of said central cavity.

10. The electrical connector housing as claimed in claim 4 further comprising means formed on at least one of an inner upper surface and an inner lower surface of said central cavity for retaining the contact module.

11. The electrical connector housing as claimed in claim 10, wherein said means for retaining the contact module comprises at least one retaining detent defined in the inner surface for being engaged with a rib formed on the contact module.

12. An electrical connector housing for use in a stacked connector assembly comprising an insulative main body having a front face adapted to engage with a mating connector;

a central cavity defined in the main body and exposed to an opposite rear face thereof;

a plurality of conductive contact receiving passageways defined in the main body in communication with said central cavity; and a pair of walls extending from a rear face of the main body, each defining an upper groove and a lower groove in a lateral surface thereof adapted to retain another electrical connector.

13. The electrical connector housing as claimed in claim 12, wherein the upper and lower grooves are adapted to retain a spacer between the walls, a slit being defined in each of the walls for guiding the spacer.

14. The electrical connector housing as claimed in claim 12, wherein at least one guiding groove is defined in opposite inner lateral surfaces of said central cavity adapted to retain a contact module.

15. A spacer for an electrical connector comprising:

a first bar having a first thickness and a second bar integrally formed with the first bar, the second bar having a second thickness different from the first thickness of the first bar, each bar defining at least one row of apertures between top and bottom surfaces thereof adapted to guide and position conductive contacts extending therethrough;

a pair of hooks formed on opposite lateral sides of the spacer adapted to lock into an electrical connector; and a pair of guiding keys provided on opposite lateral ends of the spacer for guiding attachment of the spacer to the electrical connector, the guiding keys having a length greater than a length of the hooks whereby the guiding keys engage with the electrical connector earlier than the hooks.

16. The spacer as claimed in claim 15 further comprising a plurality of standoffs formed on a bottom surface of the spacer.

17. An electrical connector comprising:

an insulative main body having a front face adapted to engage with a mating connector;

a central cavity defined in the main body and exposed to an opposite rear face thereof;

a plurality of conductive contact receiving passageways defined in the main body in communication with said central cavity;

a plurality of conductive contacts received in said passageways;

a pair of walls extending from a rear face of the main body; and a spacer retained between the walls, the spacer comprising a first bar having a first thickness and a second bar integrally formed with the first bar, the second bar having a second thickness different from the first thickness of the first bar, each bar defining at least one row of apertures for receiving and positioning tails of the conductive contacts;

wherein the spacer forms a pair of hooks for engaging with grooves defined in the walls to retain the spacer between the walls and a pair of up-standing keys for insertion into a pair of vertical slits defined in the walls, the keys having a length greater than a length of the hooks so that the keys engage with the vertical slits earlier than the hooks engage with the grooves thereby guiding attachment of the spacer to the walls.

* * * * *